US010723981B2

(12) United States Patent
Liu et al.

(10) Patent No.: US 10,723,981 B2
(45) **Date of Patent: *Jul. 28, 2020**

(54) LAUNDRY DETERGENT

(71) Applicant: The Procter & Gamble Company, Cincinnati, OH (US)

(72) Inventors: Xiaoyan Liu, Beijing (CN); Amaranta Ramirez-Almaraz, Cincinnati, OH (US); Li Lv, Beijing (CN); Xu Huang, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/918,174

(22) Filed: Mar. 12, 2018

(65) Prior Publication Data

US 2018/0195027 A1 Jul. 12, 2018

Related U.S. Application Data

(63) Continuation of application No. 14/821,837, filed on Aug. 10, 2015, now Pat. No. 9,951,300.

(30) Foreign Application Priority Data

Aug. 11, 2014 (WO) ..... CN2014/084072
Jul. 21, 2015 (WO) ..... CN2015/084559

(51) Int. Cl.

| | |
|---|---|
| ***C11D 3/42*** | (2006.01) |
| ***C11D 3/50*** | (2006.01) |
| ***C11D 17/04*** | (2006.01) |
| ***C11D 17/00*** | (2006.01) |
| ***C11D 3/34*** | (2006.01) |

(52) U.S. Cl.
CPC ..... *C11D 3/42* (2013.01); *C11D 3/3418* (2013.01); *C11D 3/505* (2013.01); *C11D 17/0039* (2013.01); *C11D 17/043* (2013.01); *C11D 17/044* (2013.01)

(58) Field of Classification Search
None
See application file for complete search history.

(56) References Cited

U.S. PATENT DOCUMENTS

| | | | | |
|---|---|---|---|---|
| 8,357,649 | B2 | 1/2013 | Chieffi et al. | |
| 8,759,275 | B2 | 6/2014 | Smets et al. | |
| 9,011,887 | B2 | 4/2015 | Chieffi et al. | |
| 9,951,300 | B2 * | 4/2018 | Liu | C11D 17/0039 |
| 2011/0111999 | A1 | 5/2011 | Smets et al. | |
| 2011/0112005 | A1 | 5/2011 | Brooker et al. | |
| 2012/0122750 | A1 * | 5/2012 | Stenger | C09B 31/072 510/299 |
| 2012/0304402 | A1 | 12/2012 | Miracle et al. | |
| 2013/0232700 | A1 | 9/2013 | Smith et al. | |
| 2013/0345108 | A1 * | 12/2013 | Lock | C11D 1/04 510/299 |
| 2015/0210969 | A1 * | 7/2015 | Brandt-Sanz | B65D 75/322 510/220 |
| 2015/0267155 | A1 * | 9/2015 | Brooker | C11D 17/045 8/137 |
| 2015/0267156 | A1 * | 9/2015 | Brooker | C11D 17/045 8/137 |
| 2015/0275152 | A1 * | 10/2015 | Brooker | C11D 17/042 510/296 |
| 2016/0040104 | A1 | 2/2016 | Liu et al. | |

FOREIGN PATENT DOCUMENTS

| | | | |
|---|---|---|---|
| EP | 2757146 | B1 | 1/2018 |
| WO | WO2005017085 | A1 | 2/2005 |
| WO | WO2011120772 | A1 | 10/2011 |
| WO | WO2016023408 | A1 | 2/2016 |

OTHER PUBLICATIONS

PCT Search Report for application No. PCT/CN2014/084072, dated May 12, 2015, 5 pages., WO.

* cited by examiner

*Primary Examiner* — Lorna M Douyon
(74) *Attorney, Agent, or Firm* — Andrés E. Velarde

(57) ABSTRACT

Liquid laundry detergent compositions containing a microcapsule with a cationically charged coating and a fluorescent brightener with a distyrylbiphenyl unit, preferably Fluorescent Brightener-49, are provided. The compositions provide improved delivery efficiency of microcapsules and brightening of fabric whilst minimizing phase stability issues.

12 Claims, No Drawings

LAUNDRY DETERGENT

FIELD OF THE INVENTION

The present invention relates to liquid laundry detergent compositions to provide fabric care benefits agent(s) and fluorescent brightener to treated fabric. The present invention also relates to the use of these compositions within a water soluble unit dose form.

BACKGROUND OF THE INVENTION

Microcapsules are known to improve the delivery efficiency of fabric care benefit agents (e.g., perfume oils etc) in liquid laundry detergent compositions. However, further delivery efficiency improvements are desired as these microcapsules may be lost before or after they are applied to the situs of interest such as a fabric, due to factors such as mechanical interactions involved in a wash cycle and/or charge interactions. In certain applications, the deposition of microcapsules is improved by coating the microcapsule with a deposition aid, e.g., a cationic polymer. Such a cationically charged coating enhances the deposition of the microcapsules onto fabrics, particularly onto negatively charged fabrics, e.g., cotton. However, these cationically charged microcapsules also interact with other ingredients in the liquid laundry detergent to exhibit undesirable chemical compatibility or decrease efficacy of an ingredient. This incompatibility can manifest itself as phase instability, especially at pilot scale that subjects the formulation to more rigorous processing conditions.

The use of optical brighteners, also known as fluorescent whitening agents, have long be used in fabric care products to compensate for the yellow tint of fibers be adding blue fluorescence to the light reflected by the fabric.

There is a need for a liquid laundry detergent composition that provides improved delivery efficiency of benefit agents by microcapsules having cationically charged coating to enhance the deposition of the microcapsules, and to provide fluorescent brighter benefits to treated fabric—while being phase stable.

It is an advantage of the present invention to have a phase stable composition at near pH neutral conditions for inter alia hand mildness benefits.

It is also an advantage of the present invention to have a phase stable composition that minimizes the use of hydrotropes.

SUMMARY OF THE INVENTION

In one aspect, the present invention is directed to a liquid laundry detergent composition comprising: a) 0.1% to 80%, preferably 1% to 25%, more preferably from 2% to 20% by weight of the composition, of a surfactant, preferably wherein the surfactant comprises at least an anionic surfactant, more preferably the surfactant comprises an anionic surfactant and an nonionic surfactant; b) 0.01% to 5%, preferably from 0.05% to 2%, weight of the composition, of a microcapsule, wherein said microcapsule comprises: a shell comprising an outer surface, a core encapsulated within said shell, and a coating coating said outer surface, wherein said coating is cationically charged; and c) 0.001% to 0.5%, preferably from 0.01% to 0.2% by weight of the composition of a fluorescent brightener containing a distyrylbiphenyl unit. Preferably, such fluorescent brightener is 2,2'-([1,1'-Biphenyl]-4,4'-diyldi-2,1-ethenediyl)bis-benzenesulfonic acid disodium salt ("Fluorescent Brightener 49").

Another aspect of the invention provides for a water soluble unit dose form of a laundry detergent article, comprising at least a first compartment and a second compartment. The first compartment contains a first composition comprising a microcapsule, wherein said microcapsule comprises: a shell comprising an outer surface, a core encapsulated within said shell, and a coating coating said outer surface, wherein said coating is cationically charged. The the second compartment contains a second composition comprising a fluorescent brightener, especially a fluorescent brightener incompatible with the aforementioned microcapsule, e.g., those containing a diaminostilbene unit.

Another aspect of the present invention is directed to the use of the inventive liquid laundry detergent compositions or articles for pretreating a fabric. Yet another aspect provides for the use of the inventive liquid laundry detergent compositions or articles for washing laundry comprising the step of dosing said composition or article to a laundry washing machine or hand washing laundry basin.

DETAILED DESCRIPTION OF THE INVENTION

In the present invention, applicant has surprisingly found that by utilizing distyrylbiphenyl-based fluorescent brightener, such as Fluorescent Brightener 49, in combination with a microcapsule with a cationic coating, the laundry detergent compositions exhibit minimizes phase instability, particularly on larger scale operation (e.g., pilot plant, wherein compositions are subjected to greater external mixing forces). Furthermore, the phase stability is achieved at near neutral pH and/or minimizing the use of hydrotropes. Meanwhile, desired delivery efficiency of the microcapsule is achieved because the cationically charged coating enhances the deposition of the microcapsule onto fabrics, as well as effective brightening of treated fabric. Without wishing to be bound by theory, it is believed that due to distyrylbiphenyl (DSBP) based brightener's superior solubility in the composition systems as compared to diaminostilbene (DAS) based brighteners. Thus, any negative interaction between the microcapsule and brightener is mitigated to achieve improved laundry detergent compositional phase stability, particularly under the aforementioned conditions.

Definitions

As used herein, the term "liquid laundry detergent composition" means a liquid composition relating to cleaning or treating fabrics. Examples of liquid laundry detergent compositions include, but are not limited to: laundry detergent, laundry detergent additive, and the like. The term "liquid cleaning composition" herein refers to compositions that can be in a form selected from the group consisting of pourable liquid, gel, cream, and combinations thereof. The liquid laundry detergent composition may be either aqueous or non-aqueous, and may be anisotropic, isotropic, or combinations thereof. The liquid laundry detergent composition can be contained and dispensed from, including, but not limited to a sachet, a plastic bottle, a bottle with a pourable spout and/or dosing cap, a bottle in fluid communication with a dispensing pump, a container with a press tap, a unit dose water soluble article (wherein the article(s)) can be contained in a secondary package such as a plastic container with a re-closable lid or a re-sealable plastic bag.

As used herein, the term "surfactant" refers to surfactants that can be cationic, nonionic, anionic, amphoteric, or zwitterionic surfactants.

As used herein, the term "alkyl" means a hydrocarbyl moiety which is branched or unbranched, substituted or unsubstituted. Included in the term "alkyl" is the alkyl portion of acyl groups.

As used herein, the term "pretreat" refers to a type of user's cleaning activity that treats a fabric, particularly a portion of fabric that has tough stains, with a cleaning composition beforehand (i.e., prior to a wash cycle). Typically a tough stain is easier to be removed by pretreating because the concentration of the composition is relatively high (than that in a washing solution) and the stain is precisely targeted.

As used herein, when a composition is "substantially free" of a specific ingredient, it is meant that the composition comprises less than a trace amount, alternatively less than 0.1%, alternatively less than 0.01%, alternatively less than 0.001%, by weight of the composition of the specific ingredient.

As used herein, the articles including "a" and "an" when used in a claim, are understood to mean one or more of what is claimed or described.

As used herein, the terms "comprise", "comprises", "comprising", "include", "includes", "including", "contain", "contains", and "containing" are meant to be non-limiting, i.e., other steps and other ingredients which do not affect the end of result can be added. The above terms encompass the terms "consisting of" and "consisting essentially of".

Liquid Cleaning Composition

The liquid cleaning composition of the present invention comprises an amphoteric surfactant and a microcapsule comprising a shell comprising an outer surface, a core encapsulated within the shell, and a coating coating the outer surface, wherein the coating is cationically charged. In one embodiment, the amphoteric surfactant is present from 0.1% to 5%, preferably from 0.2% to 3%, more preferably from 0.3% to 2%, by weight of the composition, in the composition. In one embodiment, the microcapsule is present from 0.11% to 0.25%, preferably from 0.15% to 0.2%, by weight of the composition, in the composition. In the present invention, it has been found that, since the cationically charged coating enhances the deposition of the microcapsule, the present composition allows for a relatively low level of microcapsules in the composition, whilst maintaining a comparable delivery efficiency of the microcapsules.

The liquid cleaning composition herein may be acidic or alkali or pH neutral, depending on the ingredients incorporated in the composition. The pH range of the liquid cleaning composition is preferably from 6 to 12, more preferably from 7 to 11, even more preferably from 8 to 10.

The liquid cleaning composition can have any suitable viscosity depending on factors such as formulated ingredients and purpose of the composition. In one embodiment, the composition has a high shear viscosity value, at a shear rate of 20/sec and a temperature of 21° C., of 200 to 3,000 cP, alternatively 300 to 2,000 cP, alternatively 500 to 1,000 cP, and a low shear viscosity value, at a shear rate of 1/sec and a temperature of 21° C., of 500 to 100,000 cP, alternatively 1000 to 10,000 cP, alternatively 1,500 to 5,000 cP.

Surfactant

The laundry detergent composition can comprise any surfactant that is suitable for cleaning or treating fabric. One or more types of surfactant may be used.

In one embodiment, the composition comprises an anionic surfactant. Non-limiting examples of anionic surfactants include: linear alkylbenzene sulfonate (LAS), preferably $C_{10}$-$C_{16}$ LAS; $C_{10}$-$C_{20}$ primary, branched-chain and random alkyl sulfates (AS); $C_{10}$-$C_{18}$ secondary (2,3) alkyl sulfates; sulphated fatty alcohol ethoxylate (AES), preferably $C_{10}$-$C_{18}$ alkyl alkoxy sulfates ($AE_xS$) wherein preferably x is from 1-30, more preferably x is 1-3; $C_{10}$-$C_{18}$ alkyl alkoxy carboxylates preferably comprising 1-5 ethoxy units; mid-chain branched alkyl sulfates as discussed in U.S. Pat. Nos. 6,020,303 and 6,060,443; mid-chain branched alkyl alkoxy sulfates as discussed in U.S. Pat. Nos. 6,008,181 and 6,020,303; modified alkylbenzene sulfonate (MLAS) as discussed in WO 99/05243, WO 99/05242, and WO 99/05244; methyl ester sulfonate (MES); and alpha-olefin sulfonate (AOS). Preferably, the composition comprises an anionic surfactant selected from the group consisting of LAS, AES, AS, and a combination thereof, more preferably selected from the group consisting of LAS, AES, and a combination thereof. The total level of the anionic surfactant (s) may be from 5% to 95%, alternatively from 8% to 70%, alternatively from 10% to 50%, alternatively from 12% to 40%, alternatively from 15% to 30%, by weight of the liquid detergent composition.

In one embodiment, the composition herein comprises a nonionic surfactant. Non-limiting examples of nonionic surfactants include: C12-C18 alkyl ethoxylates, such as Neodol® nonionic surfactants available from Shell; C6-C12 alkyl phenol alkoxylates wherein the alkoxylate units are a mixture of ethyleneoxy and propyleneoxy units; C12-C18 alcohol and C6-C12 alkyl phenol condensates with ethylene oxide/propylene oxide block alkyl polyamine ethoxylates such as PLURONIC® available from BASF; C14-C22 mid-chain branched alcohols, BA, as discussed in U.S. Pat. No. 6,150,322; C14-C22 mid-chain branched alkyl alkoxylates, BAEx, wherein x is from 1-30, as discussed in U.S. Pat. Nos. 6,153,577, 6,020,303 and 6,093,856; alkylpolysaccharides as discussed in U.S. Pat. No. 4,565,647 Llenado, issued Jan. 26, 1986; specifically alkylpolyglycosides as discussed in U.S. Pat. Nos. 4,483,780 and 4,483,779; polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408. Also useful herein as nonionic surfactants are alkoxylated ester surfactants such as those having the formula R1C(O)O(R20)nR3 wherein R1 is selected from linear and branched C6-C22 alkyl or alkylene moieties; R2 is selected from C2H4 and C3H6 moieties and R3 is selected from H, CH3, C2H5 and C3H7 moieties; and n has a value between 1 and 20. Such alkoxylated ester surfactants include the fatty methyl ester ethoxylates (MEE) and are well-known in the art; see for example U.S. Pat. Nos. 6,071,873; 6,319,887; 6,384,009; 5,753,606; WO 01/10391, WO 96/23049. The preferred nonionic surfactant as a co-surfactant is C12-C15 alcohol ethoxylated with an average of 7 moles of ethylene oxide (e.g., Neodol®25-7 available from Shell).

In one embodiment, the surfactant is an amphoteric surfactant, and may comprise: derivatives of secondary and tertiary amines, derivatives of heterocyclic secondary and tertiary amines, and derivatives of quaternary ammonium, quaternary phosphonium or tertiary sulfonium compounds. The amphoteric surfactant may comprises an amine oxide or a betaine.

Preferred amine oxides are alkyl dimethyl amine oxide or alkyl amido propyl dimethyl amine oxide, more preferably alkyl dimethyl amine oxide and especially coco dimethyl amine oxide. In one embodiment, the amine oxide herein is a water-soluble amine oxide characterized by the formula R1-N(R2)(R3)O wherein R1 is a is a $C_{8-22}$ alkyl, a $C_{8-22}$ hydroxyalkyl, or a $C_{8-22}$ alkyl phenyl group, and R2 and R3 are independently selected from the group consisting of methyl, ethyl, propyl, isopropyl, 2-hydroxyethyl, 2-hydroxypropyl, 3-hydroxypropyl, and a polyethylene oxide group containing an average of from 1 to 3 ethylene oxide groups. Amine oxide may have a linear or mid-branched alkyl moiety. Typical linear amine oxides include water-soluble amine oxides containing one R1 $C_{8-22}$ alkyl moiety and 2 R2 and R3 moieties independently selected from $C_{1-3}$ alkyl groups, $C_{1-3}$ hydroxyalkyl groups, or a polyethylene oxide group containing an average of from 1 to 3 ethylene oxide groups. The linear amine oxide surfactants in particular may include linear $C_{10-18}$ alkyl dimethyl amine oxides and linear $C_{8-12}$ alkoxy ethyl dihydroxy ethyl amine oxides. Preferred amine oxides include linear $C_{10}$, lincear $C_{12}$, linear $C_{10-12}$, and linear $C_{12-14}$ alkyl dimethyl amine oxides.

Preferred betaines include: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines. Preferably the betain is a cocoamidopropyl betain, in particular cocoamidopropylbetain.

Microcapsule

The microcapsule of the present invention comprises a shell comprising an outer surface, a core encapsulated within the shell, and a coating coating the outer surface, wherein the coating is cationically charged. Typically, the shell is a solid material with well defined boundaries, while the coating that adheres to the shell may not have a clear boundary, particularly in an execution of polymer-coated microcapsule that is described below. The term "cationically charged" herein means that the coating per se is cationic (e.g., by containing a cationic polymer or a cationic ingredient) and does not necessarily mean that the shell is cationic too. Instead, many known microcapsules have anionic shells, e.g., melamine formaldehyde. These microcapsules having anionic shells can be coated with a cationic coating and thus fall within the scope of the microcapsule of the present invention. Preferably the coating comprises an efficiency polymer. The term "polymer" herein can be either homopolymers polymerized by one type of monomer or copolymers polymerized by two or more different monomers. The efficiency polymer herein can be either cationic or neutral or anionic, but preferably is cationic. In the execution that the efficiency polymer is anionic or neutral, the coating comprises other ingredients that render its cationic charge. In the execution that the efficiency polymer is cationic, the polymer may comprise monomers that are neutral or anionic, as long as the overall charge of the polymer is cationic. Such a polymer-coated microcapsule and the manufacturing process thereof are described in U.S. Patent Application No. 2011/0111999A.

The core of the microcapsule herein comprises a benefit agent, typically selected from those ingredients that are desired to deliver improved longevity or that are incompatible with other ingredients in a liquid cleaning composition. The benefit agent is preferably selected from the group consisting of perfume oil, silicone, wax, brightener, dye, insect repellant, vitamin, fabric softening agent, paraffin, enzyme, anti-bacterial agent, bleach, and a combination thereof. In one preferred embodiment, the core comprises a perfume oil. This perfume-encapsulated microcapsule is known as "perfume microcapsule" ("PMC"). PMC are described in the following references: US 2003/215417 A1; US 2003/216488 A1; US 2003/158344 A1; US 2003/165692 A1; US 2004/071742 A1; US 2004/071746 A1; US 2004/072719 A1; US 2004/072720 A1; EP 1,393,706 A1; US 2003/203829 A1; US 2003/195133 A1; US 2004/087477 A1; US 2004/0106536 A1; U.S. Pat. Nos. 6,645,479; 6,200,949; 4,882,220; 4,917,920; 4,514,461; U.S. RE 32,713; U.S. Pat. No. 4,234,627.

In the PMC execution, the encapsulated perfume oil can comprise a variety of perfume raw materials depending on the nature of the product. For example, when the product is a liquid laundry detergent, the perfume oil may comprise one or more perfume raw materials that provide improved perfume performance under high soil conditions and in cold water. In one embodiment, the perfume oil comprises an ingredient selected from the group consisting of allo-ocimene, allyl caproate, allyl heptoate, amyl propionate, anethol, anisic aldehyde, anisole, benzaldehyde, benzyl acetate, benzyl acetone, benzyl alcohol, benzyl butyrate, benzyl formate, benzyl iso valerate, benzyl propionate, beta gamma hexenol, camphene, camphor, carvacrol, laevo-carveol, d-carvone, laevo-carvone, cinnamyl formate, citral (neral), citronellol, citronellyl acetate, citronellyl isobutyrate, citronellyl nitrile, citronellyl propionate, cuminic alcohol, cuminic aldehyde, Cyclal C, cyclohexyl ethyl acetate, decyl aldehyde, dihydro myrcenol, dimethyl benzyl carbinol, dimethyl benzyl carbinyl acetate, dimethyl octanol, diphenyl oxide, ethyl acetate, ethyl aceto acetate, ethyl amyl ketone, ethyl benzoate, ethyl butyrate, ethyl hexyl ketone, ethyl phenyl acetate, eucalyptol, eugenol, fenchyl acetate, fenchyl alcohol, flor acetate (tricyclo decenyl acetate), frutene (tricyclo decenyl propionate), gamma methyl ionone, gamma-n-methyl ionone, gamma-nonalactone, geraniol, geranyl acetate, geranyl formate, geranyl isobutyrate, geranyl nitrile, hexenol, hexenyl acetate, cis-3-hexenyl acetate, hexenyl isobutyrate, cis-3-hexenyl tiglate, hexyl acetate, hexyl formate, hexyl neopentanoate, hexyl tiglate, hydratropic alcohol, hydroxycitronellal, indole, isoamyl alcohol, alpha-ionone, beta-ionone, gamma-ionone, alpha-irone, isobornyl acetate, isobutyl benzoate, isobutyl quinoline, isomenthol, isomenthone, isononyl acetate, isononyl alcohol, para-isopropyl phenylacetaldehyde, isopulegol, isopulegyl acetate, isoquinoline, cis-jasmone, lauric aldehyde (dodecanal), Ligustral, d-limonene, linalool, linalool oxide, linalyl acetate, linalyl formate, menthone, menthyl acetate, methyl acetophenone, methyl amyl ketone, methyl anthranilate, methyl benzoate, methyl benzyl acetate, methyl chavicol, methyl eugenol, methyl heptenone, methyl heptine carbonate, methyl heptyl ketone, methyl hexyl ketone, alpha-iso "gamma" methyl ionone, methyl nonyl acetaldehyde, methyl octyl acetaldehyde, methyl phenyl carbinyl acetate, methyl salicylate, myrcene, neral, nerol, neryl acetate, nonyl acetate, nonyl aldehyde, octalactone, octyl alcohol (octanol-2), octyl aldehyde, orange terpenes (d-limonene), para-cresol, para-cresyl methyl ether, para-cymene, para-methyl acetophenone, phenoxy ethanol, phenyl acetaldehyde, phenyl ethyl acetate, phenyl ethyl alcohol, phenyl ethyl dimethyl carbinol, alpha-pinene, beta-pinene, prenyl acetate, propyl butyrate, pulegone, rose oxide, safrole, alpha-terpinene, gamma-terpinene, 4-terpinenol, alpha-terpineol, terpinolene, terpinyl acetate, tetrahydro linalool, tetrahydro myrcenol, tonalid, undecenal, veratrol, verdox, vertenex, viridine, and a combination thereof.

The shell of the microcapsule herein preferably comprises a material selected from the group consisting of aminoplast, polyacrylate, polyethylene, polyamide, polystyrene, polyisoprenes, polycarbonates, polyester, polyolefin, polysaccharide (e.g., alginate or chitosan), gelatin, shellac, epoxy resin, vinyl polymer, water insoluble inorganic, silicone, and a combination thereof. Preferably, the shell comprises a material selected from the group consisting of aminoplast, polyacrylate, and a combination thereof.

Preferably, the shell of the microcapsule comprises an aminoplast. A method for forming such shell microcapsules includes polycondensation Aminoplast resins are the reaction products of one or more amines with one or more aldehydes, typically formaldehyde. Non-limiting examples of suitable amines include urea, thiourea, melamine and its derivates, benzoguanamine and acetoguanamine and combinations of amines. Suitable cross-linking agents (e.g., toluene diisocyanate, divinyl benzene, butanediol diacrylate etc.) may also be used and secondary wall polymers may also be used as appropriate, e.g. anhydrides and their derivatives, particularly polymers and co-polymers of maleic anhydride as disclosed in WO 02/074430. In one embodiment, the shell comprises a material selected from the group consisting of a urea formaldehyde, a melamine formaldehyde, and a combination thereof, preferably comprises a melamine formaldehyde (cross-linked or not).

In one preferred embodiment, the core comprises a perfume oil and the shell comprises a melamine formaldehyde. Alternatively, the core comprises a perfume oil and the shell comprises a melamine formaldehyde and poly(acrylic acid) and poly(acrylic acid-co-butyl acrylate).

The microcapsule of the present invention should be friable in nature. Friability refers to the propensity of the microcapsule to rupture or break open when subjected to direct external pressures or shear forces or heat. In the PMC execution, the perfume oil within the microcapsules of the present invention surprisingly maximizes the effect of the microcapsule bursting by providing a perfume that "blooms" upon the microcapsule rupturing.

In one preferred embodiment, the efficiency polymer is of formula (V),

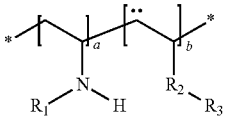

(V)

wherein:

a) a and b each independently range from 50 to 100,000;

b) each R' is independently selected from H, $CH_3$, (C═O) H, alkylene, alkylene with unsaturated C—C bonds, $CH_2$—CROH, (C═O)—NH—R, (C═O)—$(CH_2)_n$—OH, (C═O)—R, $(CH_2)_n$-E, —$(CH_2$—CH(C═O))$_n$—XR, —$(CH_2)_n$—COOH, —$(CH_2)_n$—$NH_2$, or —$CH_2)_n$—(C═O) $NH_2$, the index n ranges from 0 to 24, E is an electrophilic group, R is a saturated or unsaturated alkane, dialkylsiloxy, dialkyloxy, aryl, or alkylated aryl, preferably further containing a moiety selected from the group consisting of cyano, OH, COOH, $NH_2$, NHR, sulfonate, sulphate, —$NH_2$, quaternized amine, thiol, aldehyde, alkoxy, pyrrolidone, pyridine, imidazol, imidazolinium halide, guanidine, phosphate, monosaccharide, oligo, polysaccharide, and a combination thereof;

c) $R^2$ or $R^3$ is absent or present:

(i) when $R^3$ is present each $R^2$ is independently selected from —$NH_2$, —COO—, —(C═O)—, —O—, —S—, —NH—(C═O)—, —$NR_1$—, dialkylsiloxy, dialkyloxy, phenylene, naphthalene, or alkyleneoxy; and each $R^3$ is independently selected from the same group as R1;

(ii) when $R^3$ is absent each $R^2$ is independently selected from —$NH_2$, —COO—, —(C═O)—, —O—, —S—, —NH—(C═O)—, —$NR_1$—, dialkylsiloxy, dialkyloxy, phenylene, naphthalene, or alkyleneoxy; and (iii) when $R^2$ is absent, each $R^3$ is independently selected the same group as $R^1$; and wherein the efficiency polymer has an average molecular mass from about 1,000 Da to about 50,000,000 Da; a hydrolysis degree of from about 5% to about 95%; and/or a charge density from about 1 meq/g to about 23 meq/g.

In one embodiment, the efficiency polymer has:

a) an average molecular mass from 1,000 Da to 50,000,000 Da, alternatively from 5,000 Da to 25,000,000 Da, alternatively from 10,000 Da to 10,000,000 Da, alternatively from 340,000 Da to 1,500,000 Da;

b) a hydrolysis degree of from 5% to 95%, alternatively from 7% to 60%, alternatively from 10% to 40%; and/or c) a charge density from 1 meq/g to 23 meq/g, from 1.2 meq/g to 16 meq/g, from 2 meq/g to about 10 meq/g, or even from 1 meq/g to about 4 meq/g.

In one embodiment, the efficiency polymer is selected from the group consisting of polyvinyl amine, polyvinyl formamide, polyallyl amine, and copolymers thereof. In one preferred embodiment, the efficiency polymer is polyvinyl formamide, commercially available from BASF AG of Ludwigshafen, Germany, under the name of Lupamin® 9030. In an alternative embodiment, the efficiency polymer comprises a polyvinylamide-polyvinylamine copolymer.

Suitable efficiency polymers such as polyvinylamide-polyvinylamine copolymers can be produced by hydrolization of the polyvinylformamide starting polymer. Suitable efficiency polymers can also be formed by copolymerisation of vinylformamide with arcylamide, acrylic acid, acrylonitrile, ethylene, sodium acrylate, methyl acrylate, maleic anhydride, vinyl acetate, n-vinylpyrrolidine. Suitable efficiency polymers or oligomers can also be formed by cationic polymerisation of vinylformamide with protonic acids, such as methylsulfonic acid, and or Lewis acids, such as boron trifluoride.

Particle size and average diameter of the microcapsules can vary from 1 micrometer to 100 micrometers, alternatively from 5 micrometers to 80 microns, alternatively from 10 micrometers to 75 micrometers, and alternatively between 15 micrometers to 50 micrometers. The particle size distribution can be narrow, broad, or multimodal. Multimodal distributions may be composed of different types of capsule chemistries.

In one embodiment, the microcapsule utilized herein generally has an average shell thickness ranging from 0.1 micron to 30 microns, alternatively from 1 micron to 10 microns. In one embodiment, the microcapsule herein has a coating to shell ratio in terms of thickness of from 1:200 to about 1:2, alternatively from 1:100 to 1:4, alternatively from 1:80 to about 1:10, respectively.

The microcapsule can be combined with the composition at any time during the preparation of the liquid cleaning composition. The microcapsule can be added to the composition or vice versa. For example, the microcapsule may be post dosed to a pre-made composition or may be combined with other ingredients such as water, during the preparation of the composition.

The microcapsule herein may be contained in a microcapsule slurry. In the context of the present invention, a microcapsule slurry is defined as a watery dispersion, preferably comprising from 10% to 50%, alternatively from 20% to 40%, by weight of the slurry, of the microcapsules.

The microcapsule slurry herein can comprise a water-soluble salt. The term "water-soluble salt" herein means water-soluble ionic compounds, composed of dissociated positively charged cations and negatively charged anions. It is defined as the solubility in demineralised water at ambient temperature and atmospheric pressure. The microcapsule slurry may comprise from 1 mmol/kg to 750 mmol/kg, alternatively from 10 mmol/kg to 300 mmol/kg, of the water-soluble salt. In one embodiment, the water-soluble salt can be present as a residual impurity of the microcapsule slurry. This residual impurity can be from other ingredients in the microcapsule slurry, which are purchased from various suppliers. Alternatively, the water-soluble salt is intentionally added to the microcapsule slurry to adjust the rheology profile of the microcapsule slurry, thereby improving the stability of the slurry during transport and long-term storage.

Preferably, the water-soluble salt present in the microcapsule slurry is formed of polyvalent cations selected from alkaline earthmetals, transition metals or metals, together with suitable monoatomic or polyatomic anions. In one embodiment, the water-soluble salt comprises cations, the cations being selected from the group consisting of Beryllium, Magnesium, Calcium, Strontium, Barium, Scandium, Titan, Iron, Copper, Aluminium, Zinc, Germanium, and Tin, preferably are Magnesium. In one embodiment, the water-soluble salt comprises anions, the anions being selected from the group consisting of Fluorine, Chlorine, Bromine, Iodine, Acetate, Carbonate, Citrate, hydroxide, Nitrate, Phosphite, Phosphate and Sulfate, preferably the anions are the monoatomic anions of the halogens. Most preferably, the water-soluble salt is magnesium chloride, and the magnesium chloride is preferably present in the slurry from 0.1% to 5%, preferably 0.2% to 3%, by weight of the slurry.

In one embodiment of a process of making a microcapsule slurry comprising: combining, in any order, a microcapsule (without a polymer coating yet), an efficiency polymer, and optionally a stabilization system, and optionally a biocide. Preferably, the efficiency polymer comprises polyvinyl formamide, and the stabilization system comprises magnesium chloride and xanthan gum. In one embodiment, the microcapsule and the efficiency polymer are permitted to be in intimate contact for at least 15 minutes, preferably for at least 1 hour, more preferably for at 4 hours before the slurry is used in a product, thereby forming a polymer coating coating the microcapsule.

Suitable microcapsules that can be turned into the polymer-coated microcapsules disclosed herein can be made in accordance with applicants' teaching, such as the teaching of US 2008/0305982 A1 and US 2009/0247449 A1. Alternatively, suitable polymer-coated capsules can be purchased from Appleton Papers Inc. of Appleton, Wis. USA.

Fluorescent Whitening Agent

The present invention is based upon the surprising discovery that certain optical brighteners (also called fluorescent whitening agents (FWA)) have improve phase stability with the cationically charged microcapsules described by the present invention. Specifically, the compound having the formula (1):

(1)

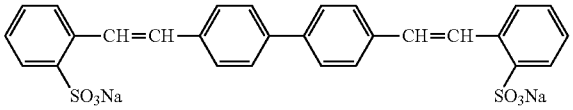

The compounds of formula (1) contain a distyrylbiphenyl (DSBP) unit as shown. See e.g., EP 0 900 783 B1; and GB-A-2 076 011. The compound of formula (1) has been described as: (i) disodium 2,2'-([1,1'-biphenyl]-4,4'-diyldivinylene)bis(benzenesulphonate); (ii) 2,2'-([1,1-Biphenyl]-4,4'-diyldi-2,1-ethenediyl)bis-benzenesulfonic acid disodium salt; or (iii) Fluorescent Brightener 49—all used interchangeably herein. Brightener 49 may be obtained from BASF under the tradename TINOPAL® CBS (CAS No. 27344-41-8).

This is in sharp contrast to diaminostilbene (DAS) based brighteners that can pose phase instability with the microcapsules having a cationically charged coating in compositions described by the present invention. An example of a DAS brighteners include Brightener 15 (disodium 4,4'-bis{[4-anilino-6-morpholino-s-triazin-2-yl]-amino}-2,2'-stilbenedisulfonate); and Brightener 36 (Disodium 4,4"-bis[(4,6-di-anilino-s-triazin-2-yl)-amino]-2,2'-stilbenedisulfonate). DAS-based brighteners may be obtained from BASF under the tradename TINOPAL® DMA (CAS No. 16090-02-1). This is particularly true under relatively pH neutral conditions and/or lower hydrotrope levels. Without wishing to be bound by theory, this may be contributed to the higher solubility of Brightener 49, as compared to Brightener 15, in the composition systems described herein. In one embodiment, the liquid laundry detergent compositions of the present invention may comprises from 0.001% to 2% of a desired fluorescent brightener (e.g., Brightener 49) by weight of the composition, preferably from 1% to 0.005%, alternatively from 0.1% to 0.01%, by weight of the composition.

Hydrotropes

One aspect of the invention provides for the minimization the use of hydrotropes. Hydrotropes are typically used in laundry detergent compositions as coupling agents to stabilize compositions, modify viscosity (i.e., typically lowering the viscosity), modify cloud-point, reduce phase separation (esp. in low temperatures), and/or limit foaming. Typical ranges include from 0.1% to 15% by weight of the composition. Non-limiting examples of hydrotropes include toluene suflonic acid, xylene sulfonic acid, cumene suflonic acid, or a salt thereof, wherein the salt is preferably selected from sodium, potassium, or ammonium, or combinations thereof.

There is an increase in phase stability observable when hydrotropes concentration is increased in the some embodiments of compositions herein described. However, there are potential disadvantages associated with elevating the amount of hydrotropes used. One disadvantage is an increase in cost. A second is negative viscosity effects. Many user segments prefer a certain viscosity to their liquid laundry detergent compositions. Generally, a thicker composition connotes quality. However, the overuse hydrotropes will decrease the desired viscosity thereby requiring the addition of thickeners or rheology modifiers to counter the negative viscosity effect of the hydrotrope. This increases costs and may potentially leads to other negative formulary consequences.

Accordingly, in one aspect of the invention, the laundry detergent composition of the present invention may composition comprises less than 5% by weight of the composition, preferably from 0% to less than 5%, more preferably from 0.01% to 4%, yet more preferably from 0.01% to 3%, alternatively less than 2%, or less than 1%, or from 0.1% to 1%, by weight of the composition of a hydrotrope. Preferably the hydrotrope is selected from the group consisting of toluene suflonic acid, xylene sulfonic acid, cumene sulfonic acid, or salts thereof. The salt may be selected from sodium, potassium, or ammonium, or combinations thereof. One preferred example of a hydrotrope is cumene sulfonic acid, or a salt thereof.

pH

Another aspect of the invention provides for near neutral pH. Hand mildness, particularly in hand washing executions, is improved with compositions having a pH at or near neutrality. The compositions that are significantly acidic or basic will cause skin irritation. Although increasing the pH may help mitigate some of the phase instability issues observed in some compositions, the solutions described by the present invention provide for phase stability without the need to increase pH. The laundry detergent composition of the present invention may have a pH below 9, preferably below pH 8.5, more preferably below pH 8, yet more preferably from pH 6.5 to below pH 8.0, alternatively have a pH from 7 to pH 8, alternatively from pH 7.6 to pH 8.4.

Rheology Modifier

In one embodiment, the composition herein comprises a rheology modifier (also referred to as a "structurant" in certain situations), which functions to suspend and stabilize the microcapsules and to adjust the viscosity of the composition so as to be more applicable to the packaging assembly. The rheology modifier herein can be any known ingredient that is capable of suspending particles and/or adjusting rheology to a liquid composition, such as those disclosed in U.S. Patent Application Nos. 2006/0205631A1, 2005/0203213A1, and U.S. Pat. Nos. 7,294,611, 6,855,680. Preferably the rheology modifier is selected from the group consisting of hydroxy-containing crystalline material, polyacrylate, polysaccharide, polycarboxylate, alkali metal salt, alkaline earth metal salt, ammonium salt, alkanolammonium salt, $C_{12}$-$C_{20}$ fatty alcohol, di-benzylidene polyol acetal derivative (DBPA), di-amido gallant, a cationic polymer comprising a first structural unit derived from methacrylamide and a second structural unit derived from diallyl dimethyl ammonium chloride, and a combination thereof.

Preferably, the rheology modifier is a hydroxy-containing crystalline material generally characterized as crystalline, hydroxyl-containing fatty acids, fatty esters and fatty waxes, such as castor oil and castor oil derivatives. More preferably the rheology modifier is a hydrogenated castor oil (HCO).

The rheology modifier can be present at any suitable level in the liquid laundry detergent composition. Preferably, the rheology modifier is present from 0.05% to 5%, preferably from 0.08% to 3%, more preferably from 0.1% to 1%, by weight of the composition, in the composition. In the HCO execution, the HCO is present from 0.05% to 1%, preferably from 0.1% to 0.5%, by weight of the composition, in the composition.

In a highly preferred embodiment, the compositions of the present invention comprise:

a) from 0.3% to 2%, by weight of the composition, of an amphoteric surfactant, wherein the amphoteric surfactant is a C10-18 alkyl dimethyl amine oxide;

b) from 0.11% to 0.25%, by weight of the composition, of a microcapsule, wherein the microcapsule comprises: a shell comprising an outer surface, a core encapsulated within the shell, and a coating coating the outer surface, wherein the coating comprises an efficiency polymer that is a polyvinyl formamide; and c) from 0.05% to 1%, by weight of the composition, of a HCO.

Composition Preparation

The compositions of the present invention are generally prepared by conventional methods such as those known in the art of making liquid laundry detergent compositions. Such methods typically involve mixing the essential and optional ingredients in any desired order to a relatively uniform state, with or without heating, cooling, application of vacuum, and the like, thereby providing compositions containing ingredients in the requisite concentrations.

Unit Dose

One aspect of the invention provides for a water soluble unit dose form of a laundry detergent article. The article may be in the form of a pouch, bag, sachet, pac, etc., and made from a water soluble biodegradable material that contains a composition of the present invention within the article for convenient dosing. In one embodiment, the water soluble biodegradable material comprises a polyvinyl alcohol, such as in a film form available from MonoSol, LLC, Merrillville, Ind., USA. In yet another embodiment, the thickness of the polyvinyl alcohol containing film is from about 10 μm to about 1,000 μm, alternatively from 20 μm to about 500 μm, alternatively combination thereof. In yet still another embodiment, the volume contained in a compartment is from 0.1 cm3 to 100 cm3, alternatively from 1 cm3 to 5 cm3, alternatively combinations thereof. A process for making thermo-formed articles is described in WO 00/55045. The film can be made by injection molding as described in WO 02/092456. A unit dose article (e.g., pouch) making unit, for example, can be a rotator drum, as described in U.S. Pat. No. 3,057,127. One non-limiting example of a water soluble unit dose form of a laundry detergent article is TIDE® PODS™ (laundry detergent pac), Procter & Gamble.

In one aspect of the invention, the unit dose article is a multi-compartment one comprises two, three, four or more compartments. In a single compartment unit dose, the article may comprise a composition according to the present invention. In a multiple compartment unit dose, the article may comprise portions of a composition of the present invention, wherein the article, in such embodiment, taken as a whole, contains the composition of the present invention.

An advantage of a multi-compartment approach is separating incompatible ingredients from each other. Accordingly, one aspect of the invention provides separating microcapsules having cationically charged coating from fluorescent brighteners, especially those brighteners showing incompatibility (e.g., those with diaminostilbene unit, such as Brightener-15). In other words, a first compartment of the unit dose article contains a first composition comprising microcapsules having cationically charged coating where as a second compartment contains a second composition comprising a brightener, especially Brightener-15 or otherwise incompatible brightener. In an embodiment, the rheology modifier (or "structurant") is further included in the first composition (comprising the microcapsules) contained in the first compartment. In yet another embodiment, the first composition contained in the first compartment is substantially free, or free, of a fluorescent brightener, especially Brightener-15. Alternatively, the first composition contained in the first compartment may comprise Brightener-49, and wherein the second composition contained in the second compartment comprises an incompatible brightener (e.g., Brightener-15) or simply the second composition is substantially free, or free, of any brightener. Alternatively still, the rheology modifier is contained in the second composition contained in the second compartment (wherein the first composition is substantially free, or free, of structurant). Alternatively yet still, the second composition is substantially free, or free, of a microcapsule having a cationically charged coated.

Adjunct Ingredient

The liquid laundry detergent compositions herein may comprise one or more adjunct ingredients. Suitable adjunct ingredients include but are not limited to: anionic surfactants, nonionic surfactants, cationic surfactants, zwitterionic surfactants, fatty acids, builders, chelating agents, dye transfer inhibiting agents, dispersants, rheology modifiers, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, photobleaches, structure elasticizing agents, fabric softeners, carriers, hydrotropes, processing aids, solvents, hueing agents, anti-microbial agents, free perfume oils, silicone emulsion, and/or pigments. In addition to the disclosure below, suitable examples of such other adjunct ingredients and levels of use are found in U.S. Pat. Nos. 5,576,282, 6,306,812, and 6,326,348. The precise nature of these adjunct ingredients and the levels thereof in the liquid laundry detergent composition will depend on factors like the specific type of the composition and the nature of the fabric treatment for which it is to be used.

EXAMPLES

The Examples herein are meant to exemplify the present invention but are not used to limit or otherwise define the scope of the present invention.

Examples 1A-1B, 2A-2E and 4A-4C are examples according to the present inventions.

Example 1A: 84 wt % Core/16 wt % Wall Melamine Formaldehyde Perfume Microcapsule 25 grams of butyl acrylate-acrylic acid copolymer emulsifier (Colloid C351, 25% solids, pka 4.5-4.7, (Kemira Chemicals, Inc. Kennesaw, Ga. U.S.A.) is dissolved and mixed in 200 grams deionized water. The pH of the solution is adjusted to pH of 4.0 with sodium hydroxide solution. 8 grams of partially methylated methylol melamine resin (Cymel 385, 80% solids, (Cytec Industries West Paterson, N.J., U.S.A.)) is added to the emulsifier solution. 200 grams of perfume oil is added to the previous mixture under mechanical agitation and the temperature is raised to 50° C. After mixing at higher speed until a stable emulsion is obtained, the second solution and 4 grams of sodium sulfate salt are added to the emulsion. This second solution contains 10 grams of butyl acrylate-acrylic acid copolymer emulsifier (Colloid C351, 25% solids, pka 4.5-4.7, Kemira), 120 grams of distilled water, sodium hydroxide solution to adjust pH to 4.8, 25 grams of partially methylated methylol melamine resin (Cymel 385, 80% solids, Cytec). This mixture is heated to 70° C. and maintained overnight with continuous stirring to complete the encapsulation process. 23 grams of acetoacetamide (Sigma-Aldrich, Saint Louis, Mo., U.S.A.) is added to the suspension. An average capsule size of 30 um is obtained as analyzed by a Model 780 Accusizer.

Example 1B: Polymer-Coated Perfume Microcapsule

Polymer-coated perfume microcapsules are prepared by weighing 99 g of melamine formaldehyde perfume microcapsules slurry obtained from Example 1A and 1 g of polyvinyl formamide (16% active, commercially available from BASF AG of Ludwigshafen, Germany, under the name of Lupamin® 9030) in a glass jar. The ingredients are shortly mixed with a spoon and are further mixed overnight in a shaker. Thus, a polymer-coated perfume microcapsule is obtained.

Example 2A-2C: Formulations of Liquid Laundry Detergent Compositions of the Present Invention

TABLE 1

| | 2A | 2B | 2C |
|---|---|---|---|
| $C_{12-14}AE_{1-3}S$ | 5 | 6 | 6 |
| $C_{11-13}LAS$ | 6 | 6 | 6 |
| Neodol ®25-7 a | 4 | 4 | 4 |
| Citric acid | 1.2 | 1.2 | 1.2 |
| Boric acid | 1.9 | 1.9 | 1.9 |
| $C_{12}$-$C_{18}$ fatty acid | 1 | 1 | 1 |
| Na-DTPA b | 0.2 | 0.2 | 0.2 |
| 1,2 propanediol | 2 | 2 | 2 |
| Calcium formate | 0.03 | 0.03 | 0.03 |
| Sodium cumene sulphonate | 0.2 | 0.2 | 0.2 |
| Silicone (PDMS) emulsion | 0.0025 | 0.0025 | 0.0025 |
| Monoethanolamine | 0.096 | 0.096 | 0.096 |
| NaOH (up to pH) | pH 7.6 | pH 7.6 | pH 8.3 |
| Brightener-15 | — | — | — |
| Protease | 0.3 | 0.3 | 0.3 |
| Amylase | 0.03 | 0.03 | 0.03 |
| Dye | 0.006 | 0.006 | 0.006 |
| Neat perfume oil | 0.4 | 0.4 | 0.4 |
| Perfume microcapsule of Example 1B | 0.15 | 0.15 | 0.15 |
| Hydrogenated castor oil | 0.12 | 0.12 | 0.12 |
| Water | Add to 100 | Add to 100 | Add to 100 |

a Neodol ®25-7 is $C_{12}$-$C_{15}$ alcohol ethoxylated with an average of 7 moles of ethylene oxide as a nonionic surfactant, available from Shell
b penta sodium salt diethylene triamine penta acetic acid as a chelant Preparation of the compositions of Examples 2A-2C are described by the following steps:

a) mixing a combination of NaOH and water in a batch container by applying a shear of 200 rpm;

b) adding citric acid, boric acid, $C_{11}$-$C_{13}$ LAS, and NaOH into the batch container, keeping on mixing by applying a shear of 200 rpm;

c) cooling down the temperature of the combination obtained in step b) to 25° C.;

d) adding $C_{12-14}AE_{1-3}S$, Na-DTPA, Neodol®25-7, $C_{12}$-$C_{18}$ fatty acid, 1,2 propanediol, and calcium formate, sodium cumene sulphonate, and silicone emulsion, into the batch container, mixing by applying a shear of 250 rpm until the combination is homogeneously mixed, and adjusting pH to 8;

e) adding brightener, protease, amylase, dye, and neat perfume oil into the batch container, mixing by applying a shear of 250 rpm;

f) adding perfume microcapsule obtained in Example 1B, and mixing by applying a shear of 250 rpm for 1 minute; and g) adding monoethanolamine and hydrogenated castor oil into the batch container, thus forming a liquid laundry detergent composition, wherein each ingredient in the composition is present in the level as specified for Examples 2A-2C in Table 1.

Examples 3A-3E are subjected to controlled aeration levels to assess liquid laundry compositional phase stability as predictive of large scale production. Compositions having cationically coated perfume microcapsules and Brightener-49 are phase stable while those compositions having cationically coated perfume microcapsules with Brightener-15 are not. Phase stability is observed with those compositions having Brightner-15 and perfume microcapsules without a cationic coating.

Examples 3A-3E are prepared according the formulation details below.

| Ingredients: | Ex. 3A | Ex. 3B | Ex. 3C | Ex. 3D | Ex. 3E |
|---|---|---|---|---|---|
| Total Surfactant* | 15.396% | 15.396% | 14.971% | 15.347% | 14.761% |
| Brightener 15 | 0.049% | 0.049% | 0% | 0% | 0% |
| Brightener 49 | 0% | 0% | 0.050% | 0.050% | 0% |
| Perfume capsule of 1A | 0% | 0.200% | 0% | 0% | 0% |
| Perfume capsule of 1B | 0.200% | 0% | 0.200% | 0.200% | 0.200% |
| Sodium Formate | 0.920 | 0.920 | 0.020 | 0.020 | 0.020 |
| 1,2 Propanediol | 3.021% | 3.021% | 3.434% | 3.021% | 3.021% |
| Sodium Cumene Sulphonate | 0.349% | 0.349% | 0.349% | 0.349% | 0.349% |
| Ethanol | 0.254% | 0.254% | 0.254% | 0.254% | 0.254% |
| Hydrogenated castor oil | 0.120% | 0.120% | 0.120% | 0.120% | 0.120% |
| Sodium Borate | 0.680% | 0.680% | 0.680% | 0.680% | 0.680% |
| Water and Adjunct Ingredients | Up to 100 | Up to 100 | Up to 100 | Up to 100 | Up to 100 |
| Initial pH | 8.28 | 8.41 | 8.32 | 8.32 | 8.38 |
| Initial Viscosity 60 RPM | 577.7 | 508.7 | 366 | 378 | 400 |
| Compression 40° C. - 1 week | 5% | 0% | 0% | 0% | 0% |
| Compression 40° C. - 2 weeks | 11% | 0% | 0% | 0% | 0% |

*Total surfactant is comprises of about 8.7 wt % of $C_{24}$ $AE_3S$; about 5.6 wt % $C_{11.8}$ LAS; less than 1 wt % $C_{24}$ nonionic having an average of 6.5 moles of ethylene oxide; and less than 1 wt % of $C_{12}$-$C_{24}$ amine oxide.

Compositions are subjected to controlled aeration as predictive of the conditions that these compositions are subjected to during large scale production. Air entrapment is well known to be an unwanted transformation part of a large scale liquid laundry detergent composition making process. While making such compositions at a lab bench scale can confirm preliminary stability of the formula; the incorporation of controlled aeration levels as a process variable is important to deliver a more robust assessment of the formulation space closing the gap on accurate stability prediction from lab bench to large scale production.

Controlled aeration is delivered with OAKS FOAMER® equipment. Generally the equipment is a tank to hold the composition to be aerated, an air compressor, and a pump with pressure and air flow meters used to control the amount of air added to the composition. Example 3A-3E are subjected to aeration prior to the addition of perfume microcapsules and hydrogenated castor oil. These ingredients are added to scaled down conditions of pressure and volume. Quantification of aeration levels in the compositions is by way of a pycnometer assessing the specific gravity between aerated and un-aerated compositions to provide 2% aeration levels (akin to what is observed at large scale production levels) across Examples 3A-3E. Those percentages above 0% are indicative of samples being phase unstable.

Example 3A, notably having Brightener 15 and cationically coated microcapsule, is phase unstable as demonstrated by stress testing at 1 week and 2 weeks at 40° C. Results indicate compression levels at 5% and 11% at weeks 1 and 2, respectively. Without wishing to be bound by theory, it is the combination of the cationically charged coating and Brightener 15 that provides the negative interaction. Microscopy images (not shown), and wishing not to be bound by theory, suggest that a low solubility of Brightener 15 triggers hydrogenated castor oil (i.e., structurant) flocculation, which is aggravated in those formulations with high levels of air entrapment.

Examples 3B-3E are stable by demonstrating no percentage increase of compression at the 1 and 2 week time durations. Example 3B, notably containing an uncoated microcapsule and Brightener-15, is stable. Without wishing to be bound by theory, given that the perfume microcapsule is not cationically coated in Example 3B, there is no negative interaction between the microcapsule and Brightener-15. Examples 3C and 3D, notably containing cationically charged coated microcapsule and Brightener-49, are phase stable. Example 3E, notably containing cationically charged coated microcapsule and no brightener, is phase stable.

Example 4A-4C: Additional Exemplary Formulations of Liquid Laundry Detergent Compositions of the Present Invention

| Ingredients (wt %) | 4A | 4B | 4C |
|---|---|---|---|
| Alkyl ethoxylate (EO1-3) sulfates | 8-36 | 6-8 | 15-20 |
| Linear alkylbenzene sulfonc acid | 1-12 | 3-6 | 2-5 |
| Alkyl ethoxylate (with EO7) | 0-10 | 1-5 | 3-8 |
| Amine oxide | 0-5 | 0.5-3 | 0 |
| Citric Acid | 1-4 | 1-2 | 3-5 |
| Na Borate | 0 | 1.9 | 2-4 |
| Fatty Acid | 0.5-4 | 1-1.5 | 1-3 |
| Protease | 0.025-0.09 | 0.2-0.4 | 0.001-0.1 |

-continued

| Ingredients (wt %) | 4A | 4B | 4C |
|---|---|---|---|
| Amylase | 0-0.02 | 0.02-0.05 | 0.001-0.1 |
| Cellulase | 0 | 0 | 0.001-0.1 |
| Lipase | 0 | 0 | 0.001-0.1 |
| Mannase | 0 | 0 | 0.001-0.1 |
| Zwitterionic ethoxylated quaternized sulfated hexamethylene diamine | 0-0.6 | 0 | 0 |
| Diethylene triaminepenta methylene phosphonic acid | 0.25-0.5 | 0 | 0 |
| (Diethylenetrinitrilo)penta-acetic acid | 0-0.7 | 0.06-0.2 | 0 |
| Ethylenediaminetetraacetic acid | 0 | 0 | 2-4 |
| PEG-PVAc polymer | 1-1.5 | 0 | 0 |
| Alkoxylated polyethylene-imines (with EO and/or PO side chains) | 0-5 | 0 | 2-4 |
| Brightener 49 | 0.05-0.5 | 0.06 | 0.1-0.2 |
| Perfume capsule of 1B | 0.1-0.3 | 0.2 | 0.1-0.2 |
| Neat perfume oil | 0-1 | 0.6 | 0-1 |
| Propylene glycol | 0 | 0 | 2-5 |
| Diethylene glycol | 0-4 | 0 | 0 |
| 1,2 propanediol | 1-4.5 | 2 | 0 |
| Glycerol | 0-5 | 0 | 0 |
| Ethanol | 0 | 0 | 0.5-1.5 |
| Monoethanolamine | 0-4 | 0.07-0.1 | 0 |
| Na or Ca formate | 0-0.15 | 0.03 | 0.001-0.15 |
| CaCl2 | 0.01-0.02 | 0 | 0 |
| NaOH | Adjust pH to 8-8.5 | | |
| Hydrogenated castor oil | 0.1-0.4 | 0.12 | 0.1-0.4 |
| sodium cumene sulphonate | 0-1 | 0.2 | 0 |
| silicone suds suppressor | 0-0.4 | 0.0025 | 0.01-0.4 |
| Hueing Dye | 0-0.05 | 0-0.05 | 0-0.05 |
| Water/Misc. | Balance | Balance | Balance |

Unless otherwise indicated, all percentages, ratios, and proportions are calculated based on weight of the total composition. All temperatures are in degrees Celsius (° C.) unless otherwise indicated. All measurements made are at 25° C., unless otherwise designated. All component or composition levels are in reference to the active level of that component or composition, and are exclusive of impurities, for example, residual solvents or by-products, which may be present in commercially available sources.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid laundry detergent composition comprising:

a) from 0.1% to 15%, by weight of the composition, of anionic surfactant;

b) 0.01% to 5%, by weight of the composition, of microcapsules, wherein said microcapsule comprises: a shell comprising an outer surface, said shell comprises a melamine formaldehyde, a core encapsulated within said shell, said core comprising perfume oil, and a coating on said outer surface, wherein said coating is cationically charged, said coating comprises an efficiency polymer that is a polyvinyl formamide; and c) 0.001% to 0.5%, by weight of the composition of a fluorescent brightener, wherein the fluorescent brightener is 2,2'-[1,1'-Biphenyl]-4,4'-diyldi-2,1-ethenediyl) bis-benzenesulfonic acid disodium salt ("Fluorescent Brightener 49").

2. The composition according to claim 1, wherein the anionic surfactant comprises linear alkylbenzene sulfonate (LAS), sulphated fatty alcohol ethoxylates (AES), alkyl sulfates (AS), or a combination thereof.

3. The composition according to claim 1, wherein the composition further comprises nonionic surfactant.

4. The composition according to claim 3, wherein the composition comprises from 0.1% to 15%, by weight of the composition, of the nonionic surfactant.

5. The composition according to claim 3, wherein the nonionic surfactant comprises C12-C18 alkyl ethoxylates.

6. The composition according to claim 2, wherein the composition further comprises an amphoteric surfactant, wherein the amphoteric surfactant comprises an amine oxide or a betaine.

7. The composition according to claim 1, wherein the pH of the liquid laundry detergent composition is below 9.

8. The composition according to claim 1, the composition further comprising a rheology modifier selected from the group consisting of polyacrylate, polysaccharide, polycarboxylate, alkali metal salt, alkaline earth metal salt, ammonium salt, alkanolammonium salt, $C_{12}$-$C_{20}$ fatty alcohol, di-benzylidene polyol acetal, a cationic polymer comprising a first structural unit derived from methacrylamide and a second structural unit derived from diallyl dimethyl ammonium chloride, and a combination thereof.

9. The composition according to claim 1, wherein the composition further comprises an alkali metal salt, an alkaline earth metal salt, or a combination thereof.

10. The composition according to claim 1, wherein the composition is substantially free of any other fluorescent brighteners other than Brightener Fluorescent 49.

11. The composition according to claim 1, wherein the composition further comprises a hydrotrope selected from the group consisting of toluene sulfonic acid, xylene sulfonic acid, cumene sulfonic acid, a salt thereof, and combinations thereof.

12. The composition according to claim 1, wherein said composition is contained in a first compartment of a water soluble unit dose article.

* * * * *